US005093955A

United States Patent [19]

Blehert et al.

[11] Patent Number: 5,093,955

[45] Date of Patent: Mar. 10, 1992

[54] COMBINED SWEEPER AND SCRUBBER

[75] Inventors: Michael L. Blehert, Crystal; William J. Sampson, Osseo, both of Minn.

[73] Assignee: Tennant Company, Minneapolis, Minn.

[21] Appl. No.: 574,656

[22] Filed: Aug. 29, 1990

[51] Int. Cl.[5] ..... B08B 5/04

[52] U.S. Cl. ..... 15/320; 15/328; 15/353; 15/349

[58] Field of Search ..... 15/320, 347, 349, 352, 15/353, 401, 341, 348, 321, 83

[56] References Cited

U.S. PATENT DOCUMENTS

| | | | |
|---|---|---|---|
| 4,041,567 | 8/1977 | Burgoon | 15/353 |
| 4,167,798 | 9/1979 | Klügel et al. | 15/353 |
| 4,250,592 | 2/1981 | Emrick | 15/353 |
| 4,457,036 | 7/1984 | Carlson et al. | 15/49 R |
| 4,580,313 | 4/1986 | Blehert | 15/349 |
| 4,754,521 | 7/1988 | Zoni | 15/348 |
| 4,819,676 | 4/1989 | Blehert et al. | 15/83 |

OTHER PUBLICATIONS

Hydro-Retriever 5000 (Advance Leaflet).
Star Indusries, Inc. (Leaflet in German).
Power Boss Scrubbers (Leaflet).
Tennant Bulletin 1465/465 Scrubbers.
Tennant Bulletins 186 Sweeper/Scrubber.

*Primary Examiner*—Philip R. Coe
*Assistant Examiner*—Reginald L. Alexander
*Attorney, Agent, or Firm*—Kinzer, Plyer, Dorn, McEachran & Jambor

[57] ABSTRACT

A combination floor sweeping and scrubbing machine is as compact and maneuverable as an equivalent machine which only sweeps or scrubs, while retaining typical hopper and tank volumes. Its operator can change it from sweeping to scrubbing or vice versa at any time by moving a few controls and without adding or removing any parts. It has one debris hopper and one horizontal cylindrical rotating brush and they function in both the sweeping and scrubbing modes. A vacuum system supplies dust control during sweeping and vacuum pickup of dirty solution during scrubbing. In the scrubbing mode a single tank supplies scrubbing solution and receives dirty solution picked up from the floor.

7 Claims, 1 Drawing Sheet

Fig. 1.
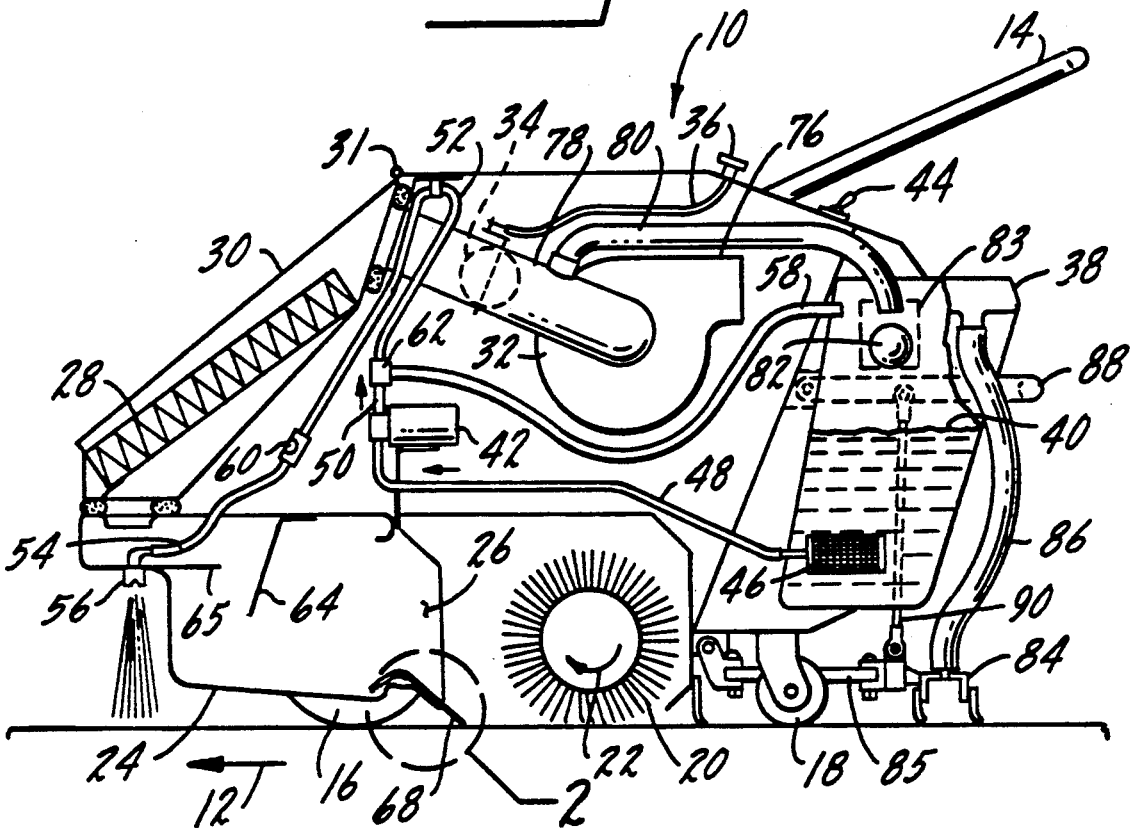
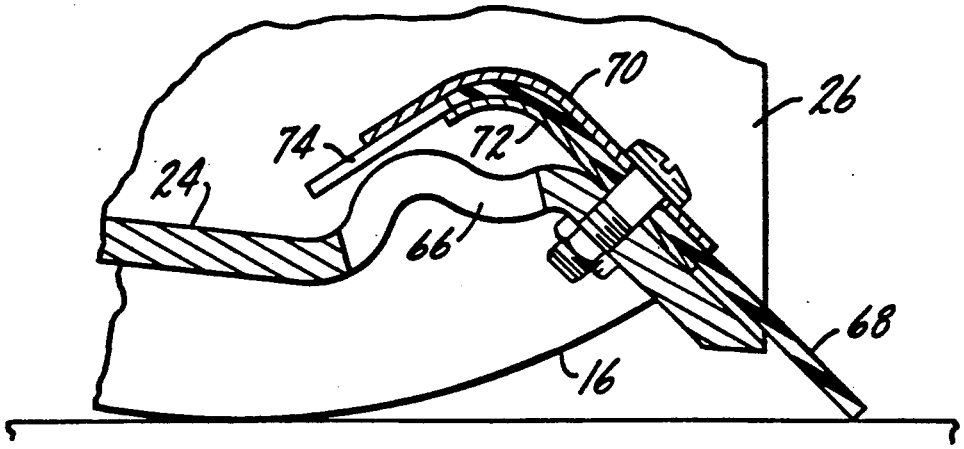
Fig. 2.

COMBINED SWEEPER AND SCRUBBER

BACKGROUND

Floors in buildings get dirty with use and must be periodically cleaned, so specialized equipment has been developed for the purpose. In particular, the requirements for floor cleaning in public, commercial, institutional and industrial buildings have led to the development of various specialized floor sweeping and scrubbing machines. One class of such equipment is comprised of rotary broom sweepers, in which a rotating cylindrical brush contacts the floor and throws loose debris into a collection hopper which is periodically emptied. Another class is comprised of scrubbers. These machines apply cleaning solution from an onboard tank to the floor, agitate it with one or more rotating brushes to loosen soilage that is adhered to the floor and suspend it in the cleaning solution. Then they pick up the soiled solution with a vacuum pickup squeegee and store it in an onboard tank for later emptying. The various uses to which buildings are put result in many different floor conditions, some of which are best cleaned by sweepers and some by scrubbers. Many buildings require both sweeping and scrubbing at different times or in different areas. This necessitates investing in both a sweeper and a scrubber, which is a substantial expense.

To reduce this investment there have been combination machines built which could perform both sweeping and scrubbing functions. One class of these is comprised of sweepers with scrubber attachments. In these there is a prime mover which is equipped with a dry debris hopper and a dust control system, in which configuration the machine functions as a sweeper. On occasion the hopper may be removed and a separate scrubber attachment installed in its place. The attachment will contain a tank for supplying cleaning solution to the floor, usually a specialized scrubbing brush, and a vacuum pickup squeegee for removing soiled solution from the floor. The attachment will also provide a tank for storing the soiled solution. These machines are effective and ar widely used. However, the cost of the separate scrubber attachment is substantial, and the time involved in changing from one mode of operation to the other adds to the operating expense.

There are also so called sweeper-scrubbers, which are machines that can either sweep or scrub without removing or adding any parts. These typically have a sweeping brush that throws debris into a hopper, and one or more other brushes that scrub. The sweeping brush and the scrubbing brush are arranged in tandem, and the added elements increase the length of the machine, with an attendant loss in maneuverability. There may be some compromise in performance; for example, the sweeper hopper may be smaller than customary, or dust control may not be provided. And the added elements increase the cost of such machines over the cost of single purpose scrubbers and sweepers.

The present invention overcome the above described shortcomings of the prior art and offers other advantages by achieving the following objects:

1. One machine which can function as a sweeper complete with dust control or as a floor scrubber complete with vacuum squeegee pickup of scrub water without removing or adding any parts.

2. One machine which can be changed from operating in sweeping mode to operating in scrubbing mode or vice versa by a machine operator at any time by manipulating one or a few conveniently located controls.

3. A compact machine for maximum maneuverability, which provides the functions of a sweeper and a scrubber in one machine which is essentially no longer than an equivalent single purpose sweeper or scrubber while retaining typical hopper and tank volumes.

4. A combination sweeping and scrubbing machine which does not require both a brush for sweeping and another brush or brushes for scrubbing, but which has one brush that is the main cleaning tool in both the sweeping mode and the scrubbing mode.

5. A combination sweeping and scrubbing machine which uses a single debris hopper to receive and store debris in both sweeping and scrubbing modes. When in the scrubbing mode this hopper functions to receive debris and scrub water from the floor and to retain the debris while returning the scrub water back to the floor so that no vacuum pickup is needed in said debris hopper to remove water from it.

6. A combination sweeping and scrubbing machine which is equipped with only one tank for maximum compactness, this one tank serving to hold cleaning solution to be dispensed to a floor to be scrubbed and also to receive soiled cleaning solution that is recovered from the scrubbed floor by a vacuum pickup squeegee.

7. A combination sweeping and scrubbing machine which in its scrubbing mode recycles a substantial part of its supply of scrub water by applying it to the floor more than once, and thereby extends its run time as compared to a machine which only uses its supply of scrub water once.

8. A single tank for a combination sweeping and scrubbing machine in which the lower portion of the tank is made to serve as a sediment sump by placing the outlet somewhat above the bottom of the tank.

9. A combination sweeping and scrubbing machine which uses fewer parts than prior art sweeper-scrubbers, and consequently has a lower manufacturing cost and fewer service problems.

BRIEF DESCRIPTION OF THE DRAWINGS

FIG. 1 is a schematic drawing of the combination sweeping and scrubbing machine of the present invention.

FIG. 2 is a view on an enlarged scale showing the detailed construction of the portion of the machine in the circle 2 in FIG. 1.

DETAILED DESCRIPTION OF THE INVENTION

A preferred embodiment of the combination sweeping and scrubbing machine of the present invention is shown generally at 10 in FIG. 1.

Its structural construction is similar to that of the machines shown in U.S. Pat. Nos. 4,580,313 and 4,819,676. These patents are incorporated here by reference and the reader may refer to them for details of construction. It will then only be necessary to give a functional description of the machine here, referring to the schematic drawing of FIG. 1, and then describe the areas of innovative difference from the prior art.

The machine is power driven in a conventional manner by a gasoline engine or by one or more battery powered electric motors. It is designed to be operated by an attendant walking behind it who guides it with handlebar 14 in a normal direction of travel indicated by arrow 12. Other controls needed by the operator are provided, but are not shown as they are conventional and well known in the art The machine is supported on a floor to be swept or scrubbed by two front wheels 16, which also drive it, and one rear caster wheel 18. A cylindrical brush 20, which rotates bottom side forward as indicated by arrow 22, serves to either sweep debris off the floor when the machine is operating in a sweeping mode or scrub the floor and also sweep up debris when a scrubbing mode is in use. The brush will be more fully described later.

A debris hopper 24 is mounted in the machine in front of the brush according to the referenced patents. In its rear wall is a large opening 26 through which debris is flung by the brush. Debris will thus accumulate in the hopper, which may be periodically removed and emptied. Certain details of the hopper construction will be described in more detail later in connection with the scrubbing mode operation of the machine.

Above the hopper is a pleated air filter 28 in a filter enclosure 30 which is mounted as described in U.S. Pat. No. 4,580,313. The filter housing is hinged at 31 and may be swung up to provide clearance for lifting out the hopper as described in U.S. Pat. No. '313. An exhaust blower 32 pulls dusty air from around the brush, through the hopper and filter, where the dust is removed, and exhausts it to atmosphere, thereby controlling any dust stirred up by the brush during sweeping. A butterfly valve 34 in the fan inlet duct may be opened or closed by a bowdon wire control 36 or other suitable control. The butterfly valve will be open when the fan is used for dust control during sweeping as described above.

From the above it will be seen that the sweeping mode. operation of the machine is quite conventional. The features which allow it to also function as a scrubber will now be discussed. Mounted at the rear of the machine is a tank 38 which may be filled to a level 40 with a desired scrubbing solution, most commonly water to which detergent has been added. The water level is chosen to utilize most of the tank capacity while still leaving an air plenum in the tank above the solution level. A pump 42 is mounted on the body structure of the machine. Model 2100-761 made by Flojet Corp. of Irvine, California is suitable, and others may be used also. The pump may be started and stopped by switch 44, which is conveniently located for the operator. Mounted in tank 38 is a fine mesh screen filter 46 which is connected to the inlet port of pump 42 by a length of flexible tubing 48.

When the pump 42 is turned on by switch 44 it will draw solution from the tank 38 and deliver it through tubes 50, 52 and 54 to spray nozzle 56, which sprays it on the floor. Part of the flow from the pump is bypassed through the tee connector 62 and a small diameter tube 58 to the air plenum in the top of tank 38, but the pump is sized to allow for this and still deliver the desired amount to the floor. The purpose of bypass tube 58 is to serve as a syphon breaker. Without it some scrubbing solution would continue to flow from the tank to the nozzle by syphon action after the pump was shut off because the pump does not serve as a positive shutoff when it is not running. Eliminating this unwanted afterflow also dictates routing tube 52 through a point which is higher than any level that solution will ever reach in the tank.

Solution supply tubes 52 and 54 are joined by a quick connect/disconnect coupling 60. One suitable coupling is supplied by Colder Products Company of St. Paul, Minnesota. When it is desired to empty debris hopper 24 the filter housing 30 is swung up out of the way, after which coupling 60 is easily disconnected. It is then possible to remove hopper 24 for emptying.

During a scrubbing operation the brush 20 will fling water forward into the hopper. If any of this were to reach filter 28 it would have an adverse effect on the filter. To prevent this two sheet metal baffles 64 and 65 are installed in the hopper as shown, extending across its full width.

The water flung forward by the brush accumulates in the bottom of the hopper. Provision is made to drain this out by piercing a row of $0.25 \times 1.00$ inch drain slots in the bottom of the hopper. Their location is shown at 66 in FIG. 2, and they are spaced every four inches across the hopper. The water runs out through them back onto the floor, where it may be recycled for further scrubbing by the brush, or may pass back to the pickup squeegee and be sucked up into the tank 38.

In a scrubbing operation there is typically a certain amount of sand, dirt, loose debris and other soilage from the floor that is also thrown by the brush into the hopper. A baffle is provided to protect the drain slots 66 from being plugged up by this material. A sheet rubber combination sweeping lip an baffle 68 is held between an upper retainer 70 and a lower retainer 72. These parts extend across the width of the hopper. The baffle 68 has $0.25 \times 1.00$ inch notches 74 along its forward edge spaced every four inches across the hopper, in staggered relationship to the drain slots 66. This design is intended to retain dirt in the hopper, pass water down to the drain slots, and keep the slots open.

The brush 20 has overall dimensions that are the same as might be used in a sweeper of comparable size. In an exemplary machine the outside diameter of the brush is ten inches and the bristles are 2.5 inches long. The bristle material is polypropylene because of its excellent dimensional stability even when wet. A somewhat stiffer fill is used than in a normal sweeping brush to improve the scrubbing performance. Stiffness will be limited by the permissible power draw, but it can be allowed as much as an equivalent scrubber. An exemplary machine uses a bristle mix of 0.015, 0.025 and 0.035-inch x-shaped polypropylene bristles. This gives good sweeping and scrubbing performance and holds the power draw within allowable limits. Thus one brush is able to serve in both sweeping and scrubbing modes, and no changing of the brush is needed when going from one mode to the other.

An exhaust blower 76 provides vacuumized air for dust control during the sweeping mode and for water pickup during the scrubbing mode. It draws in air through intake duct 78 and exhausts it to atmosphere. During the sweeping mode the butterfly valve 34 in the intake duct will be open and air will be drawn from around the brush 22, through the hopper 24 and air filter 28 to control dust stirred up by the brush. Air will also be drawn from branch duct 80, but it is smaller than the main duct 78 and passes relatively less air. The fan has more capacity than is required for effective dust control and will pull enough air from around the brush to control dusting in spite of branch duct 80 being open.

During the scrubbing mode the butterfly valve 34 will be closed so all the intake air to the fan will come from branch duct 80. There will be less air flow, but at a higher vacuum, than in the sweeping mode. Duct 80 is connected to the air plenum in the top of tank 38. A ball float valve 82 in a cage 83 is arranged to shut off the airflow in case the water level in the tank gets high enough to enter the branch duct 80. This is for the protection of the fan and is completely conventional A pickup squeegee 84 is attached to the rear of the machine with a linkage 85. A suction hose 86 connects the pickup squeegee to the air plenum in the top of tank 38. All of this is conventional, and the pickup squeegee acts in conventional fashion to remove soiled scrubbing solution from the floor and deposit it in the tank 38. The heavier debris and sludge will settle to the bottom of the tank, which thus serves as a sludge sump. Intake filter screen 46 is set high enough in the tank to be above this sump and so provides relatively clear water for application to the floor. The machine thus recycles the scrub water that has been used and picked up and thereby provides a substantially increased running time between water refills compared to a machine which does not recycle.

A link 90 connects the squeegee assembly to a handle 88. By lifting on this handle an operator can lift the squeegee off the floor. A detent, not shown, is provided for retaining the handle in this raised position so that the squeegee can be kept off the floor during sweeping mode operation. When entering scrub mode the operator can easily remove the handle from the detent and lower the squeegee to the floor.

Operation of the machine in either sweeping mode or scrubbing mode is conventional and will be familiar to anyone accustomed to operating machines of this class. Changing over from one mode to the other is quick and easy. An operator who has been sweeping and who wants to scrub only has to operate three controls. First, the bowdon wire control 36 is moved to close butterfly valve 34. Second, the squeegee lift lever 88 is moved to lower the squeegee 84 to the floor. Third, the pump switch 44 is moved to turn on the pump 42, thereby starting a flow of scrubbing solution to the floor. Scrubbing operation will commence and continue. Converting back to sweeping mode is equally simple, requiring only a reverse movement of the above three controls. The flow of scrubbing solution will cease and sweeping mode operation will begin.

As an alternative configuration, at somewhat higher cost, it would be possible to interconnect the three controls so that moving only one would effect the change from one mode to the other. For example, bowdon wire 36 could be connected to squeegee lever 88 instead of to the control knob shown, so that movement of the lever would open or close the butterfly valve as well as raise or lower the squeegee. Also, toggle switch 44 could be replaced with a push button switch located so that movement of the squeegee lever would operate the push button switch. Then all that would be needed to change from one mode to the other would be to move the squeegee lever. However, the controls as shown are easy to operate, and the additional refinements described or other variations in control configuration might not be worth their additional cost.

Other variations in the invention are also possible, as a person skilled in the art will realize. For example, at least in a battery powered model, it may be desirable to replace vacuum blower 76 with two blowers, each driven by its own electric motor. One blower would be connected to the air filter and would be tailored for the relatively large volume, low vacuum airflow typically used for dust control. The other blower would be connected to the top of tank 38 and would be specifically designed to supply the relatively low volume, high vacuum airflow typically needed for effective water pickup. Both blowers would be controlled by suitable switches readily accessible to the operator. This option of using two blowers instead of one could be accommodated within the limits of the invention.

The preferred embodiment of the invention has been described as a walk behind machine, or a machine attended by an operator walking behind it. It would be possible to build such a machine on a larger scale so that it could accommodate an operator riding on it and still embody the invention, which is not dependent on the scale of the machine or a walking operator.

As with many machine designs, it would also be possible to transpose the position of the major elements. Thus the forward throwing brush 22 and front hopper 24 could be replaced with a brush sweeping over its top into a hopper behind it, which is a familiar design in the art. The tank 38 would be moved to the front of the machine and the squeegee 84 would be under the hopper at the rear of the machine. Such a transposition of machine elements would not affect the essential features of the invention.

Whereas the preferred form and several variations o the invention have been shown, described, and suggested, it should be understood that suitable additional modifications, changes, substitutions and alterations may be made without departing from the invention's fundamental theme. It is therefore wished that the invention be unrestricted except as by the appended claims.

The embodiments of the invention in which an exclusive property or privilege is claimed are defined as follows:

1. A compact combination sweeping and scrubbing machine for sweeping a floor in a sweeping mode or scrubbing a floor in a scrubbing mode, and which can be used in either mode without the addition or removal of parts, said machine including, from front to rear, a debris hopper for both scrubbing and sweeping, a brush housing and a scrubbing solution tank, the length of the machine being essentially determined by the distance between the debris hopper and the tank, a single brush for both scrubbing and sweeping positioned in said brush housing, means on the machine for supplying solution from the tank to the vicinity of the brush and for returning used solution to the tank, at least a portion of the solution supplied from the tank to the vicinity of the brush being recycled, said machine being so constructed that the debris hopper, the brush in its brush housing and the scrubbing solution tank remain in position on the machine during both the sweeping mode and the scrubbing mode.

2. In a combination sweeper-scrubber machine for cleaning a floor type surface selectively in either a sweeping mode or a scrubbing mode, a frame adapted to proceed in a forward direction, a hopper and a permanently mounted tank in the frame, a brush for either sweeping or scrubbing mounted adjacent the center of the frame, and a squeegee on the rear of the frame, the hopper being for use as a dry debris receptacle when the machine is operating in its sweeping mode and for receiving wet debris when the machine is operating in its scrubbing mode, drain means for liquids in the hopper, a conduit system on the frame for supplying cleaning solution from the tank to the surface in the vicinity of the front of the frame and for returning used solution from the surface by way of the squeegee to the tank on the frame, means in the conduit system for recirculating at least a portion of the used solution from the tank to the surface in the vicinity of the front of the frame, means for removing impurities from the used solution prior to recirculation, a dust control system on the frame for cleaning and exhausting air from around the brush when the machine is operating in its sweeping mode, the dust control system including a filter and fan means, the fan means being used for drawing air through the filter in the sweeping mode and for creating a vacuum in the squeegee to pick up used solution in the scrubbing mode, and control means for directing air flow through the filter and fan means to atmosphere and stopping the supply of scrubbing solution from the tank to the surface when the machine is operating in its sweeping mode and for supplying scrubbing solution from the tank to the surface and stopping air flow through the filter when the machine is operating in tis scrubbing mode.

3. The structure of claim 2 further characterized in that the control means for stopping airflow through the filter include a valve for blocking communication between the fan and the filter.

4. The structure of claim 2 further characterized in that the hopper is on the front of the frame and is removably mounted.

5. The structure of claim 2 further characterized in that the brush is a generally cylindrical rotary brush having its axis of rotation horizontal and transverse to the forward direction of the frame.

6. The structure of claim 2 further characterized in that the controls include means for raising the squeegee above the surface when the machine is operating in its sweeping mode and for lowering it into contact with the surface when the machine is operating in its scrubbing mode.

7. A combination sweeper-scrubber machine operable in both a sweeping mode and a scrubbing mode for cleaning a surface, the machine having a frame, a debris hopper removably mounted on the frame, a single cylindrical rotary brush having a horizontal axis disposed laterally across the frame, a suitable brush housing mounted on the frame, a scrubbing solution tank mounted on the frame, the hopper, brush housing and tank all being longitudinally aligned on the frame and essentially contiguous, a squeegee on the frame for engaging the surface adjacent the rear of the machine, the squeegee being in liquid communication with the tank, means for raising and lowering the squeegee to place it out of contact with the surface to be cleaned during sweeping and in contact with the surface to be cleaned during scrubbing, said frame mounting an air filter and fan means for creating a vacuum, air circuit means on the frame for connecting the fan means, filter, brush housing, squeegee and solution tank, means for controlling the air circuit so that during the sweeping mode air is drawn from around the brush and through the filter and so that during the scrubbing mode a vacuum is communicated to the scrubbing solution tank so that dirty scrubbing solution from the surface adjacent the rear of the machine will be drawn through the squeegee into the tank, means for rotating the brush to propel debris from the surface into the hopper during the sweeping mode, and debris and scrubbing solution from the surface into the hopper during the scrubbing mode, the hopper having means for draining solution back onto the surface being cleaned, and means for cleaning and recirculating at least a portion of the solution from the tank and applying such recirculated solution to the surface to be cleaned adjacent the front of the machine.

* * * * *